US009307886B2

(12) United States Patent
Durham et al.

(10) Patent No.: US 9,307,886 B2
(45) Date of Patent: Apr. 12, 2016

(54) INDEXING PASSIVE DIVERTER FOR AN APPLIANCE

(71) Applicant: General Electric Company, Schenectady, NY (US)

(72) Inventors: Kyle Edward Durham, Louisville, KY (US); Craig Curtis, Crestwood, KY (US)

(73) Assignee: General Electric Company, Schenectady, NY (US)

( * ) Notice: Subject to any disclaimer, the term of this patent is extended or adjusted under 35 U.S.C. 154(b) by 104 days.

(21) Appl. No.: 14/050,656

(22) Filed: Oct. 10, 2013

(65) Prior Publication Data

US 2015/0101644 A1 Apr. 16, 2015

(51) Int. Cl.
*A47L 15/42* (2006.01)

(52) U.S. Cl.
CPC ..... *A47L 15/4221* (2013.01); *Y10T 137/86493* (2015.04)

(58) Field of Classification Search
None
See application file for complete search history.

(56) References Cited

U.S. PATENT DOCUMENTS

| | | | | |
|---|---|---|---|---|
| 3,072,129 | A * | 1/1963 | Seal | A47L 15/4223 134/107 |
| 2010/0043825 | A1* | 2/2010 | Bertsch et al. | 134/18 |
| 2012/0266924 | A1* | 10/2012 | Boyer | A47L 15/4221 134/198 |
| 2012/0318389 | A1* | 12/2012 | Holstein et al. | 137/625 |
| 2013/0000762 | A1 | 1/2013 | Buddharaju | |

* cited by examiner

*Primary Examiner* — Michael Barr
*Assistant Examiner* — Cristi Tate-Sims
(74) *Attorney, Agent, or Firm* — Dority & Manning, P.A.

(57) ABSTRACT

A passive diverter is provided that does not require a dedicated motor to switch between multiple outlet ports. The diverter uses a flow of fluid provided by a pump to switch between different outlet ports. In a dishwashing appliance, fluid from the pump that supplies one or more spray assemblies can be used to cause the diverter to switch between different fluid outlets and e.g., different spray assemblies. A separate motor to power the diverter is not required, which allows a savings in costs and space.

16 Claims, 9 Drawing Sheets

INDEXING PASSIVE DIVERTER FOR AN APPLIANCE

FIELD OF THE INVENTION

The subject matter of the present disclosure relates generally to a diverter for an appliance.

BACKGROUND OF THE INVENTION

Dishwasher appliances generally include a tub that defines a wash compartment. Rack assemblies can be mounted within the wash compartment of the tub for receipt of articles for washing. Spray assemblies within the wash compartment can apply or direct wash fluid towards articles disposed within the rack assemblies in order to clean such articles. Multiple spray assemblies can be provided including e.g., a lower spray arm assembly mounted to the tub at a bottom of the wash compartment, a mid-level spray arm assembly mounted to one of the rack assemblies, and/or an upper spray assembly mounted to the tub at a top of the wash compartment. Other configurations may be used as well.

A dishwashing appliance is typically equipped with at least one pump for circulating fluid through the spray assemblies. However, due to e.g., government regulations related to energy and/or water usage, the pump may not be able to supply fluid to all spray assemblies at the same time. Accordingly, a dishwashing appliance that can be configured to selectively control the flow through different spray assemblies or other fluid elements would be useful.

Certain conventional dishwashing appliances use a device, referred to as a diverter, to control the flow of fluid in the dishwashing appliance. For example, the diverter can be used to selectively control which flow assemblies receive a flow of fluid. In one construction, the diverter uses an electrically powered motor to rotate an element between different ports for fluid control. The motor adds a significant expense to the overall manufacturing cost of the dishwashing appliance and must be separately controlled during cleaning operations so that the proper flow is occurring.

Additionally, the motor is typically positioned below the diverter, which is positioned below the sump portion of the appliance. As such, significant space is consumed which can reduce the space available in the dishwashing compartment for placement of dishes, glasses, silverware, and other items for cleaning. Thus, a diverter that does not require an electrically powered motor to operate would be beneficial, resulting in a savings in both costs and space.

BRIEF DESCRIPTION OF THE INVENTION

The present invention provides a passive diverter, i.e.—a diverter that does not require a dedicated motor to switch between multiple outlet ports. The diverter uses the forces provided by a flow of fluid from a pump to switch between different outlet ports. In a dishwashing appliance, fluid from the pump that e.g., supplies one or more spray assemblies can be used to cause the diverter to switch between different fluid outlets and the different spray assemblies or other fluid-using elements. A separate motor to power the diverter is not required, which allows a savings in costs and space. Additional aspects and advantages of the invention will be set forth in part in the following description, may be apparent from the description, or may be learned through practice of the invention.

In one exemplary embodiment, the present invention provides a dishwasher appliance. The dishwasher appliance includes a tub that defines a wash chamber for receipt of articles for washing and a pump for providing fluid flow for cleaning the articles. A diverter receives fluid flow from the pump. The diverter defines an axial direction and has a plurality of outlet ports for providing fluid to the wash chamber. The diverter includes a housing defining a chamber. The chamber has a fluid inlet and a fluid outlet to supply fluid to the outlet ports. A disk is positioned within the fluid outlet and rotatable about an axis. The disk defines an aperture for selectively controlling fluid flow from the chamber through one of the outlet ports. The disk is movable along the axial direction between a first position and a second position. The disk defines a channel and a plurality of cams projecting into the channel. A biasing element is configured to urge the rotatable disk into the first position. A boss extends from the housing into the channel of the disk. The boss defines a plurality of guide elements. The guide elements and cams are configured to interact so that movement of the disk along the axial direction between the first position and the second position causes the disk to rotate about the axis.

In another exemplary embodiment, the present invention provides a passive diverter for selectively controlling fluid flow in an appliance. The passive diverter defines an axial direction and includes a housing having a chamber and a plurality of fluid outlet ports for providing selective control of fluid flow for the appliance. The chamber has a fluid inlet and a fluid outlet to supply fluid to the outlet ports. A disk is positioned within the fluid outlet and is rotatable about an axis. The disk defines an aperture for selectively controlling fluid flow from the chamber through one of the outlet ports. The disk is movable along the axial direction between a first position and a second position. The disk defines a channel and a plurality of cams projecting into the channel. A biasing element is configured to urge the rotatable disk into the first position. A boss extends from the housing into the channel of the disk. The boss defines a plurality of guide elements, wherein the guide elements and cams are configured to interact so that movement of the disk along the axial direction between the first position and the second position causes the disk to rotate about the axis.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention including the best mode thereof, directed to one of ordinary skill in the art, is set forth in the specification, which makes reference to the appended figures, in which.

DETAILED DESCRIPTION OF THE INVENTION

Figure 1:
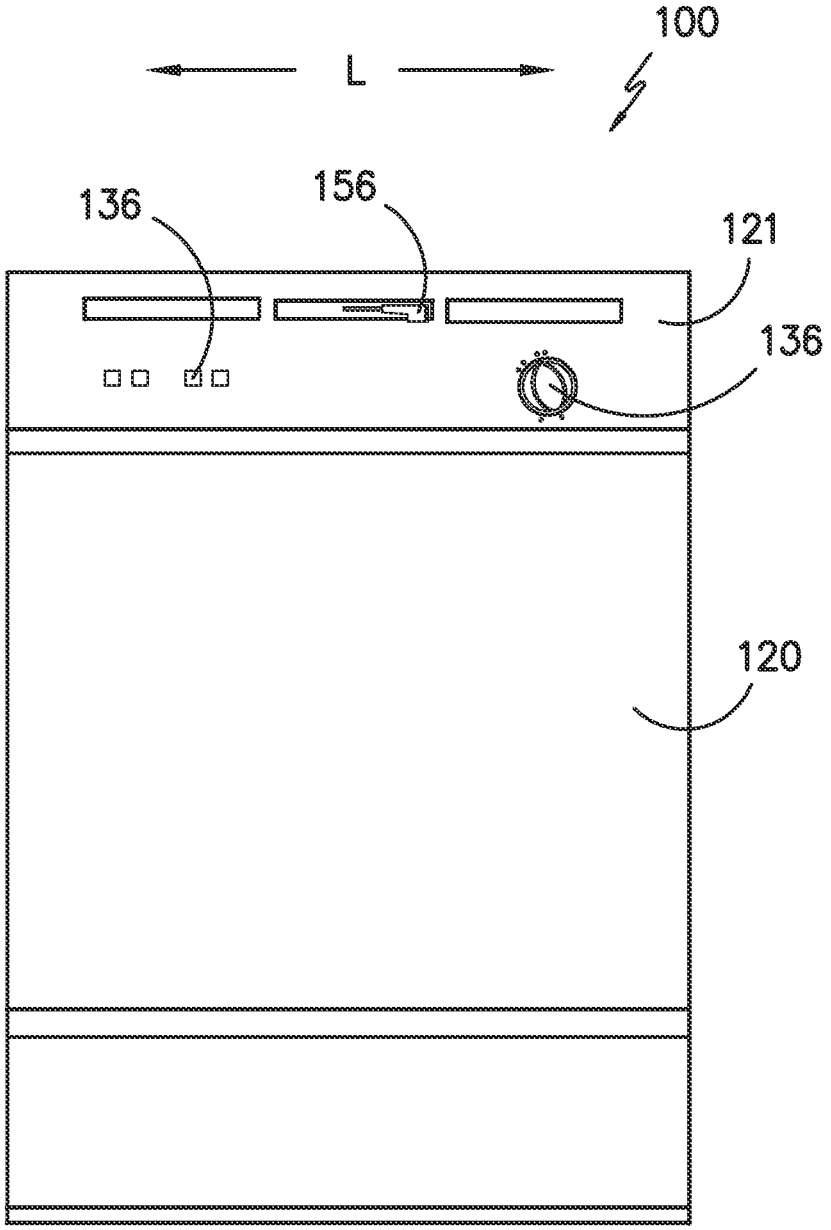
FIG. 1 provides a front view of an exemplary embodiment of a dishwashing appliance of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to, dishes, pots, pans, silverware, and other cooking utensils and items that can be cleaned in a dishwashing appliance. The term "wash cycle" is intended to refer to one or more periods of time during the cleaning process where a dishwashing appliance operates while containing articles to be washed and uses a detergent and water, preferably with agitation, to e.g., remove soil particles including food and other undesirable elements from the articles. The term "rinse cycle" is intended to refer to one or more periods of time during the cleaning process in which the dishwashing appliance operates to remove residual soil, detergents, and other undesirable elements that were retained by the articles after completion of the wash cycle. The term "drying cycle" is intended to refer to one or more periods of time in which the dishwashing appliance is operated to dry the articles by removing fluids from the wash chamber. The term "fluid" refers to a liquid used for washing and/or rinsing the articles and is typically made up of water that may include additives such as e.g., detergent or other treatments.

Figure 2:
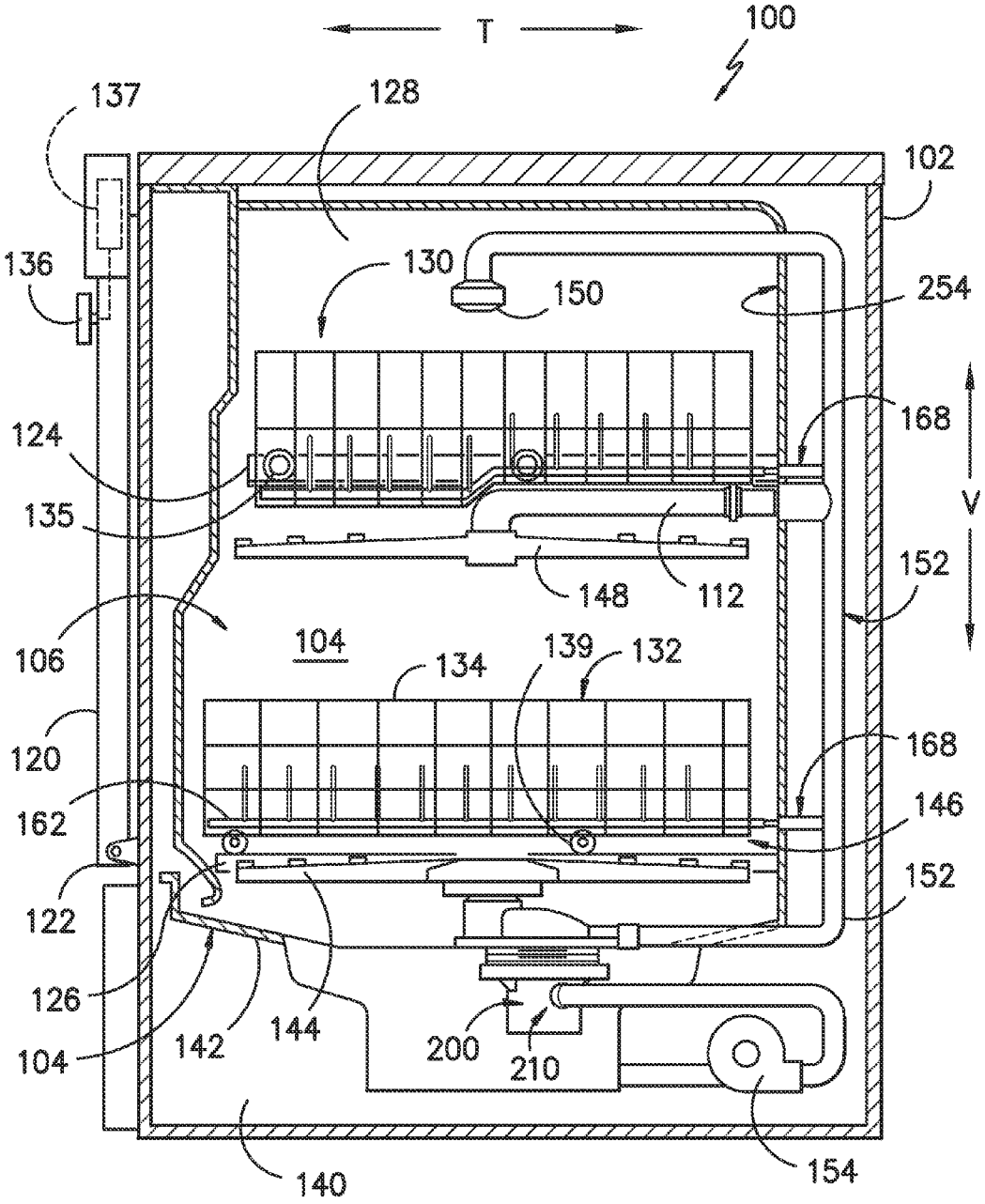
FIG. 2 provides a side, cross-sectional view of the exemplary dishwashing appliance of FIG. 1.

FIGS. 1 and 2 depict an exemplary domestic dishwasher 100 that may be configured in accordance with aspects of the present disclosure. For the particular embodiment of FIGS. 1 and 2, the dishwasher 100 includes a cabinet 102 having a tub 104 therein that defines a wash chamber 106. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. Latch 156 is used to lock and unlock door 120 for access to chamber 106.

Upper and lower guide rails 124, 126 are mounted on tub side walls 128 and accommodate roller-equipped rack assemblies 130 and 132. Each of the rack assemblies 130, 132 is fabricated into lattice structures including a plurality of elongated members 134 (for clarity of illustration, not all elongated members making up assemblies 130 and 132 are shown in FIG. 2). Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to rack assembly 132 for placement of silverware, utensils, and the like, that are otherwise too small to be accommodated by the racks 130, 132.

The dishwasher 100 further includes a lower spray-arm assembly 144 that is rotatably mounted within a lower region 146 of the wash chamber 106 and above a tub sump portion 142 so as to rotate in relatively close proximity to rack assembly 132. A mid-level spray-arm assembly 148 is located in an upper region of the wash chamber 106 and may be located in close proximity to upper rack 130. Additionally, an upper spray assembly 150 may be located above the upper rack 130.

The lower and mid-level spray-arm assemblies 144, 148 and the upper spray assembly 150 are part of a fluid circulation assembly 152 for circulating water and dishwasher fluid in the tub 104. The fluid circulation assembly 152 also includes a pump 154 positioned in a machinery compartment 140 located below the tub sump portion 142 (i.e., bottom wall) of the tub 104, as generally recognized in the art. Pump 154 receives fluid from sump 142 and provides a flow to the inlet 210 of a passive diverter 200 as more fully described below.

Each spray-arm assembly 144, 148 includes an arrangement of discharge ports or orifices for directing washing liquid received from diverter 200 onto dishes or other articles located in rack assemblies 130 and 132. The arrangement of the discharge ports in spray-arm assemblies 144, 148 provides a rotational force by virtue of washing fluid flowing through the discharge ports. The resultant rotation of the spray-arm assemblies 144, 148 and the operation of spray assembly 150 using fluid from diverter 200 provides coverage of dishes and other dishwasher contents with a washing spray. Other configurations of spray assemblies may be used as well.

The dishwasher 100 is further equipped with a controller 137 to regulate operation of the dishwasher 100. The controller may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown in FIGS. 1 and 2. In such an embodiment, input/output ("I/O") signals may be routed between the control system and various operational components of dishwasher 100 along wiring harnesses that may be routed through the bottom 122 of door 120. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or configuration of dishwasher. The exemplary embodiment depicted in FIGS. 1 and 2 is for illustrative purposes only. For example, different locations may be provided for user interface 136, different configurations may be provided for racks 130, 132, and other differences may be applied as well.

Figure 3:
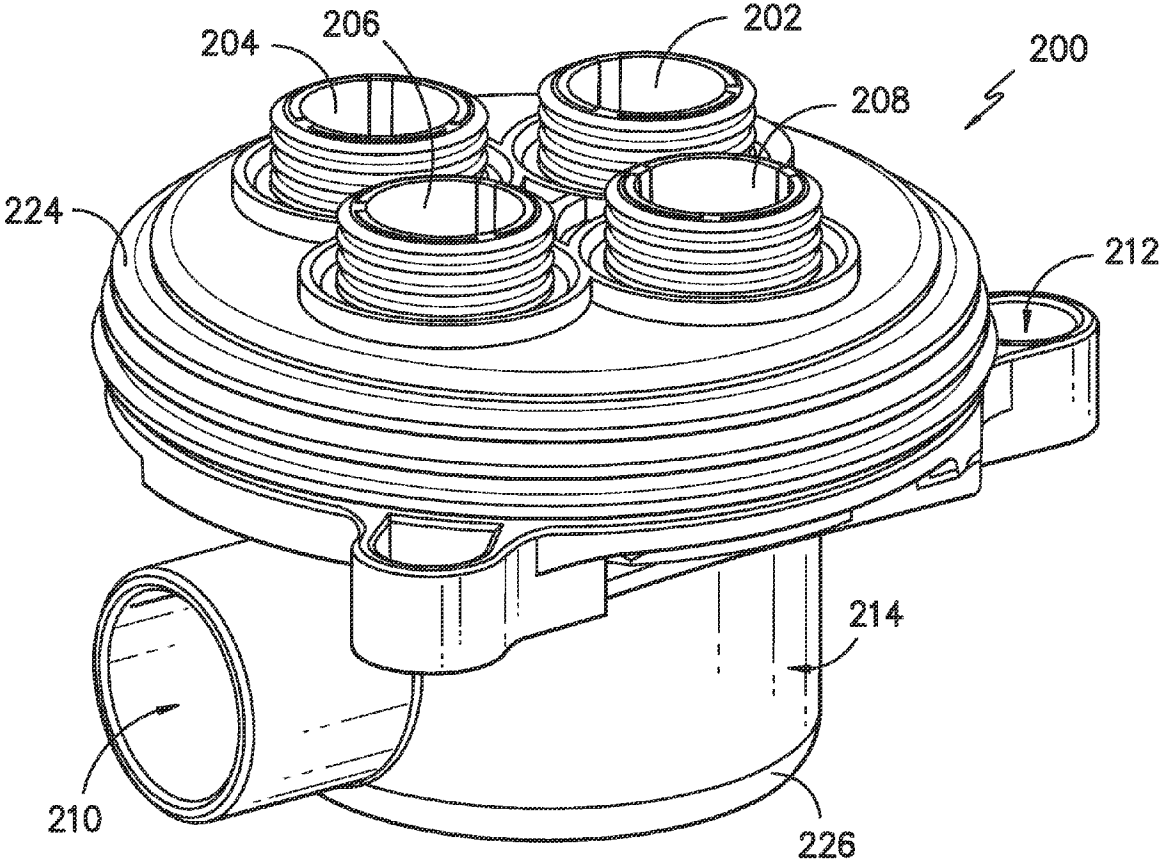
FIG. 3 is a perspective view of an exemplary embodiment of a passive diverter of the present invention.

FIG. 3 provides a top, perspective view of an exemplary embodiment of a passive diverter 200 of the present invention. Passive diverter 200 has a diverter inlet 210 for receiving a flow of fluid from pump 154 that is to be supplied to spray assemblies 144, 148, and/or 150 as well as other fluid-using components during cleaning operations. As stated, pump 154 receives fluid from e.g., sump 142 and provides a fluid flow to diverter 200.

For this exemplary embodiment, diverter 200 includes a first outlet port 202, a second outlet port 204, a third outlet port 206, and a fourth outlet port 208. However, in other embodiments of the invention, two, three, or more than four outlet ports may be used with diverter 200 depending upon e.g., the number of switchable ports desired for selectively placing pump 154 in fluid communication with different fluid-using elements of appliance 100. Diverter 200 includes a rotatable disk 222 (FIG. 9), more fully described below, that can be selectively switched between ports 202, 204, 206, and 208 without using a separate motor for such purpose. More particularly, disk 222 can be rotated so as to place its aperture 230 in fluid communication with any one of ports 202, 204, 206, and 208. As such, passive diverter 200 can be used to selectively provide fluid flow from pump 154 through any one of the outlet ports 202, 204, 206, and 208 desired.

By way of example, first outlet port 202 can be fluidly connected with upper spray assembly 150, second outlet port can be fluidly connected with mid-level spray arm assembly 148, and third and fourth outlet ports 206 and 208 might be fluidly connected with lower spray arm assembly 144. Other connection configurations may be used as well. As such, the rotation of disk 222 in passive diverter 200 can be used to selectively place pump 154 in fluid communication with any one of the spray assemblies 144, 148, or 150 by way of outlet ports 202, 204, 206, and 208. Diverter 200 includes multiple apertures 212 that allow for fastening diverter 200 to the sump 142 of wash tub 104 (FIG. 2).

Figure 4:
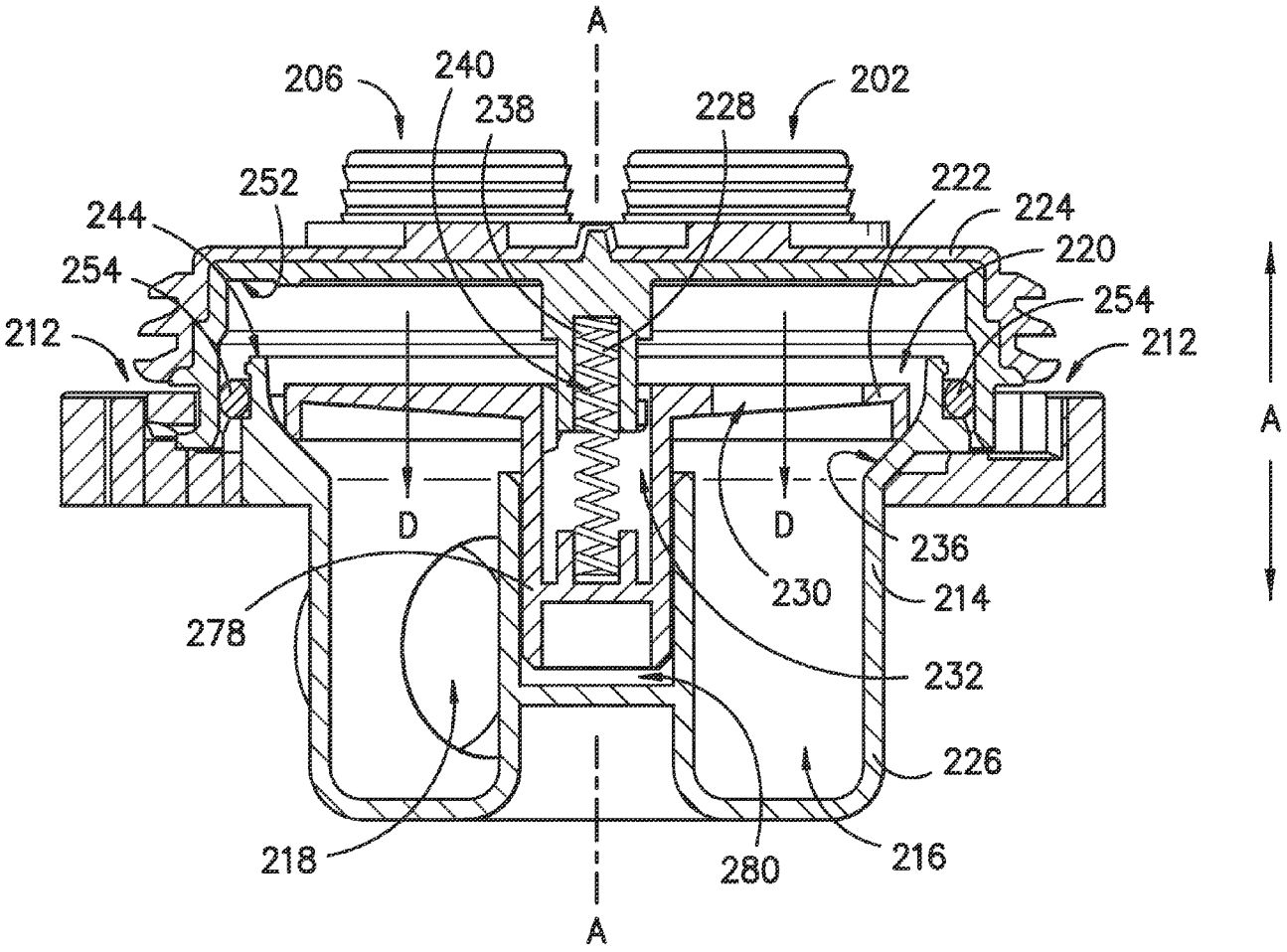
FIG. 4 is a cross-sectional view of the exemplary passive diverter of FIG. 3 with an internal disk shown in a first position.
Figure 5:
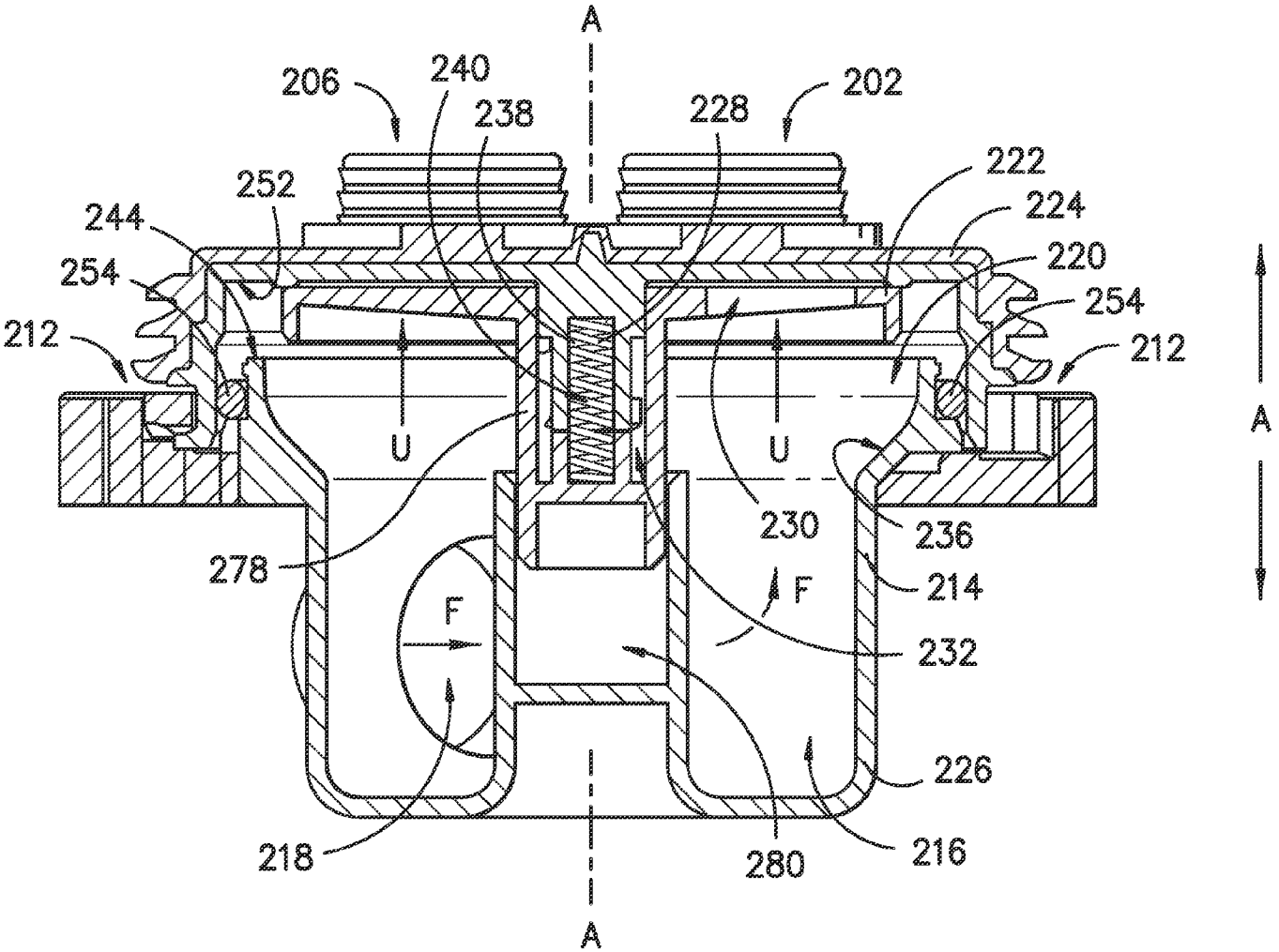
FIG. 5 is also a cross-sectional view of the exemplary passive diverter of FIG. 3 with an internal disk shown in a second position.

Referring now to FIGS. 3, 4, and 5, diverter 200 is constructed from a housing 214 that includes a top portion 224 and a bottom portion 226. An O-ring 254 provides a seal therebetween. Housing 214 defines a chamber 216 into which fluid flows through its fluid inlet 218. Chamber 216 also defines a fluid outlet 220, which is formed by the circular edge 244 at the top of bottom portion 226 (FIGS. 4 and 5).

Disk 222 is positioned within fluid outlet 220 of chamber 216. More particularly, disk 222 includes a cylindrically-shaped shaft 278 received into a cylindrically-shaped socket 280 formed by bottom portion 226 of housing 214. Disk 222 is rotatable about axis A-A relative to housing 214.

As can be seen by comparing FIGS. 4 and 5, disk 222 is movable along the axial direction A (or along axis A-A, which is parallel to the axial direction A) between a first position shown in FIG. 4 and a second position shown in FIG. 5. In the first position shown in FIG. 4, disk 222 rests on housing 214. More particularly, referring to FIGS. 4 and 10, disk 222 includes a frustoconical surface 246 positioned on the distal end of a flange 234. In turn, flange 234 projects along axial direction A from circular main body 248 of disk 222 towards fluid outlet 220 formed by bottom portion 226 of housing 214. In the first position, frustoconical surface 246 rests in a complementary manner on an interior surface 236 of bottom portion 226 that is also frustoconical in shape. In the second position shown in FIG. 5, disk 222 is pressed against diverter top 224. For this exemplary embodiment, a top surface 250 (FIGS. 9 and 10) of disk 222 contacts an interior surface 252 of top portion 224.

Movement of disk 222 back and forth between the first position shown in FIG. 4 and the second position shown in FIG. 5 is provided by two opposing forces: i) a flow of water passing through diverter 200 that is counteracted by ii) a biasing element 228. More particularly, when pump 154 is off, biasing element 228 pushes along axial direction A against disk 222 and forces it downward along axis A-A (arrows D) to the position shown in FIG. 4. Conversely, when there is a sufficient flow of fluid F through diverter housing 200, the momentum of fluid exiting chamber 216 through the fluid outlet 220 of housing 214 will impact disk 222. As the fluid passes through aperture 230 to exit diverter 200 through one of the outlet ports, this momentum overcomes the force provided by biasing element 228 so as to shift disk 222 along axial direction A (arrows U) away from diverter bottom 226 towards diverter top 224 to a second position shown in FIG. 5. Flange 234 assists in capturing the momentum provided by fluid flow through fluid outlet 220. Disk 222 will remain in the second position until the fluid flow ends or drops below a certain level. Then, biasing element 228 (shown in this exemplary embodiment as a compression spring 228) urges disk 222 along axial direction A away from diverter top 224 towards diverter bottom 226 and back into the first position shown in FIG. 4. The use of the terms "top" and "bottom," or "upper" and "lower" herein are used for reference only as diverter 200 is not limited to the vertical orientation shown nor to a two piece assembly for housing 214; other constructions and orientations may also be used.

The movement of disk 222 back and forth along axis A-A between the first and second positions shown in FIGS. 4 and 5 also causes disk 222 to rotate about axis A-A so that aperture 230 is switched between the various outlet ports 202, 204, 206, and 208. For this exemplary embodiment, a single movement in either direction (arrow U or arrow D) causes disk 222 to rotate 45 degrees. Accordingly, disk 222 rotates about axis A-A a full 90 degrees each time it is moved out of, and then returned to, either the first position (FIG. 4) or the second position (FIG. 5).

Figure 6:
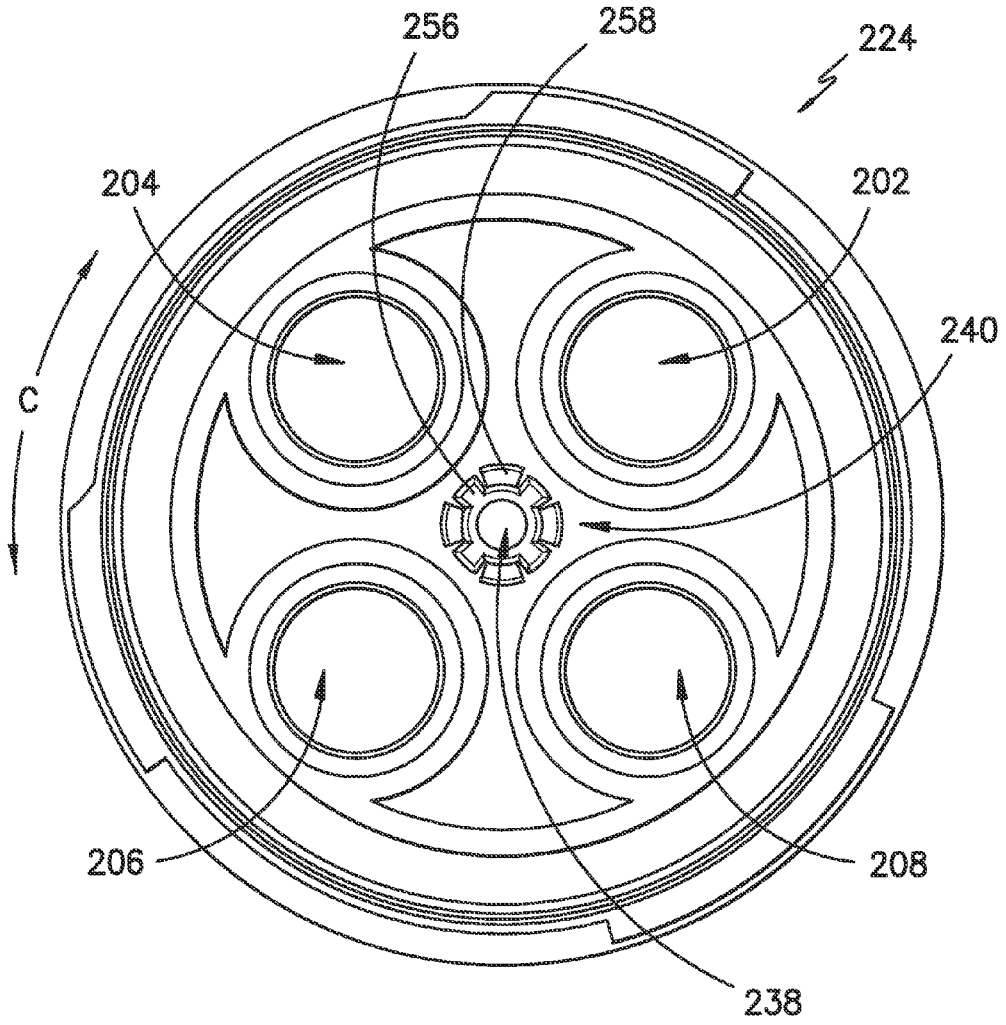
FIG. 6 is a bottom view of a top portion of a housing forming the exemplary passive diverter of FIG. 3.

As shown in FIG. 6, for this exemplary embodiment, outlet ports 202, 204, 206, and 208 are spaced apart along the circumferential direction C at angles of 90 degrees. Thus, the rotation of disk 222 by 90 degrees necessarily rotates aperture 230 so as to selectively provide fluid flow from one outlet port to the next outlet port along the direction of rotation. For example, in FIG. 5, aperture 230 places pump 154 in fluid communication with port 202 so that fluid flows out of port 202. As aperture 230 is rotated 90 degrees clockwise (as viewed looking down on top 224 of passive diverter 200), it places pump 154 in fluid communication with port 208 so that fluids flow out of port 208. Continued rotation of disk 222 can provide flow through port 206, then port 204, and then back to port 202.

Figure 7:
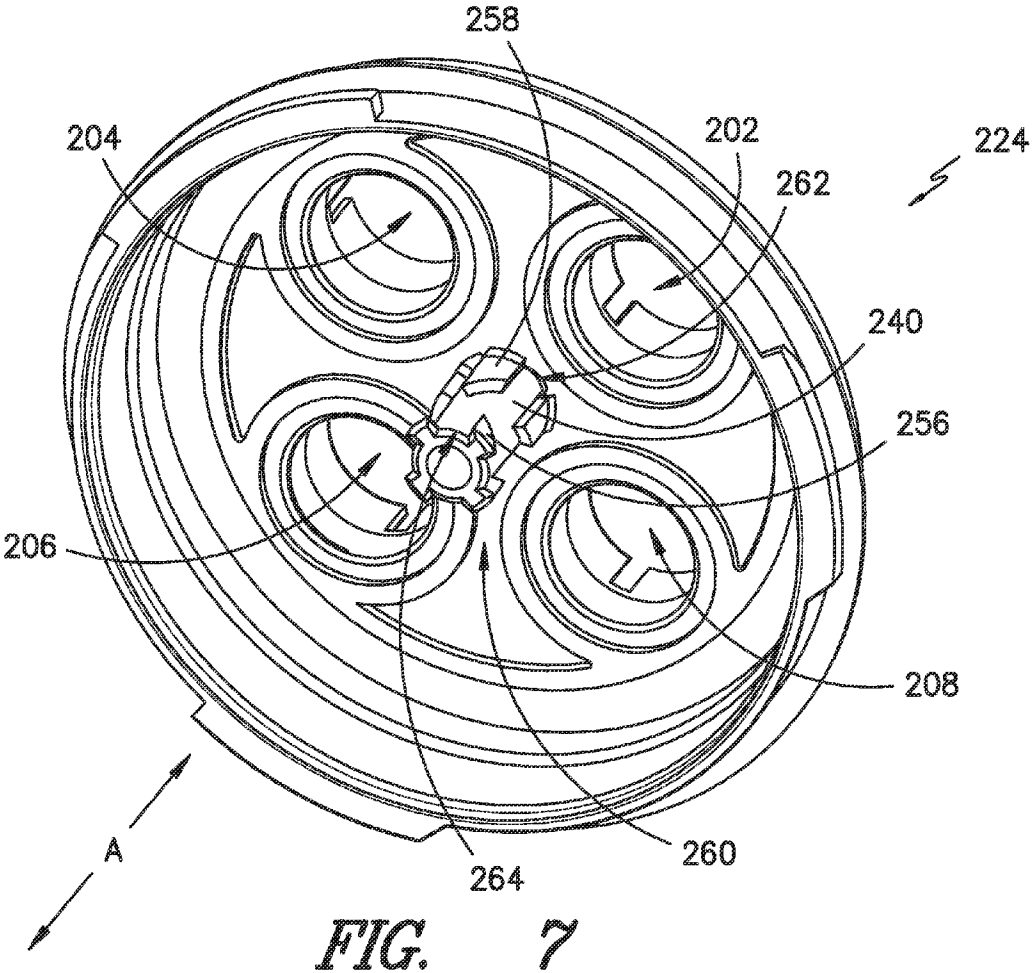
FIG. 7 is a bottom, perspective view of the top portion of the housing forming the exemplary passive diverter of FIG. 3.
Figure 8:
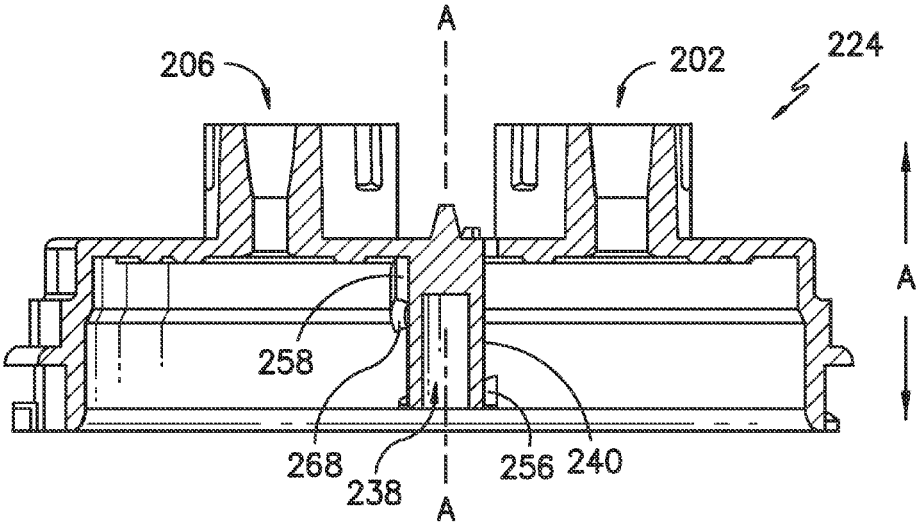
FIG. 8 is a cross-sectional, side view of the top portion of the housing forming the exemplary passive diverter of FIG. 3.

Referring now to FIGS. 6, 7, and 8, a cylindrically-shaped boss 240 extends along axis A-A from top portion 224 of housing 214 into a channel 232 (FIG. 10) defined by disk 222. Boss 240 defines recess 238 into which a first end of biasing element 228 is received. Boss 240 also includes a plurality of guide elements 256 and 258 that are spaced apart from each other along circumferential direction C. A first plurality of guide elements 256 are located near a distal end 260 of boss 240 while a second plurality of guide elements 258 are located near diverter top 224. Guide elements 256 and 258 are spaced apart along axial direction A and are also offset from each other along circumferential direction C. More particularly, as best seen in FIGS. 6 and 7, along axial direction A, each of the second plurality of guide elements 258 is aligned with a gap 264 positioned between a respective pair of the first plurality of guide elements 256. Conversely, each of the first plurality of guide elements 256 is aligned with a gap 262 between a respective pair of the second plurality of guide elements 258.

Figure 11:
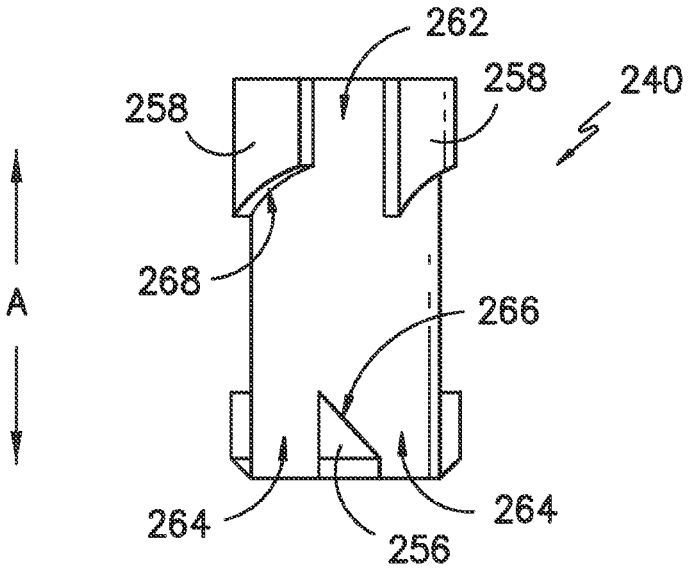
FIG. 11 is a side view of a feature (e.g., boss) that extends from the exemplary disk of FIGS. 9 and 10.

Referring now to FIG. 11, each of the guide elements 256 and 258 includes a contact face 266 and 268, respectively. Each face 266 and 268 is at a non-zero angle between zero and 90 degrees from the axial direction A. For the exemplary embodiment shown, this angle is about 45 degrees. In another embodiment, this angle is about 42 degrees. In still another embodiment, this angle is about 40 degrees to about 50 degrees from the axial direction. However, other angles may be used as well.

Figure 9:
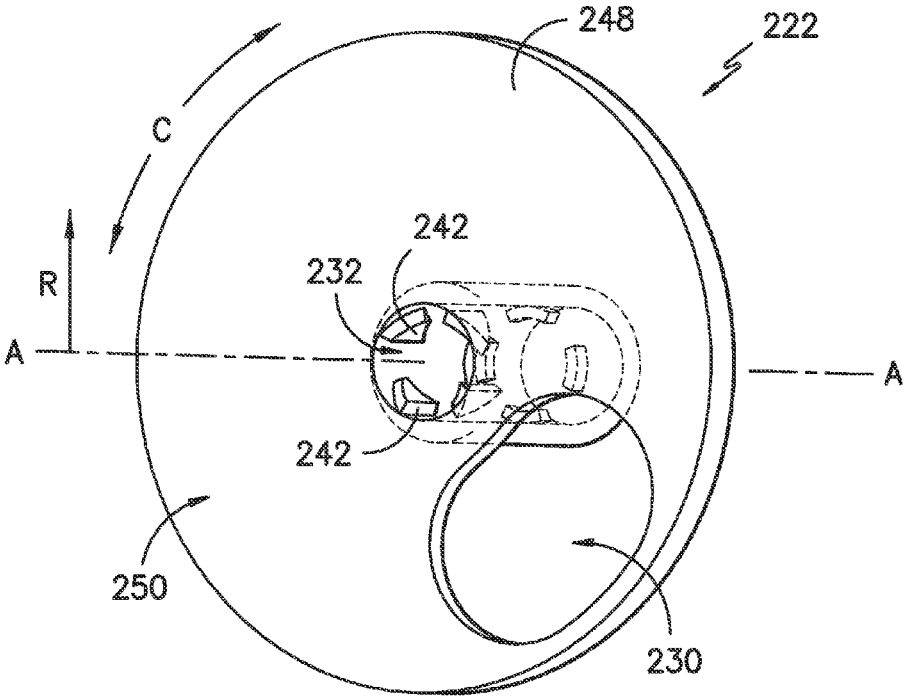
FIG. 9 is a perspective view of an exemplary embodiment of a rotating disk of the present invention.
Figure 10:
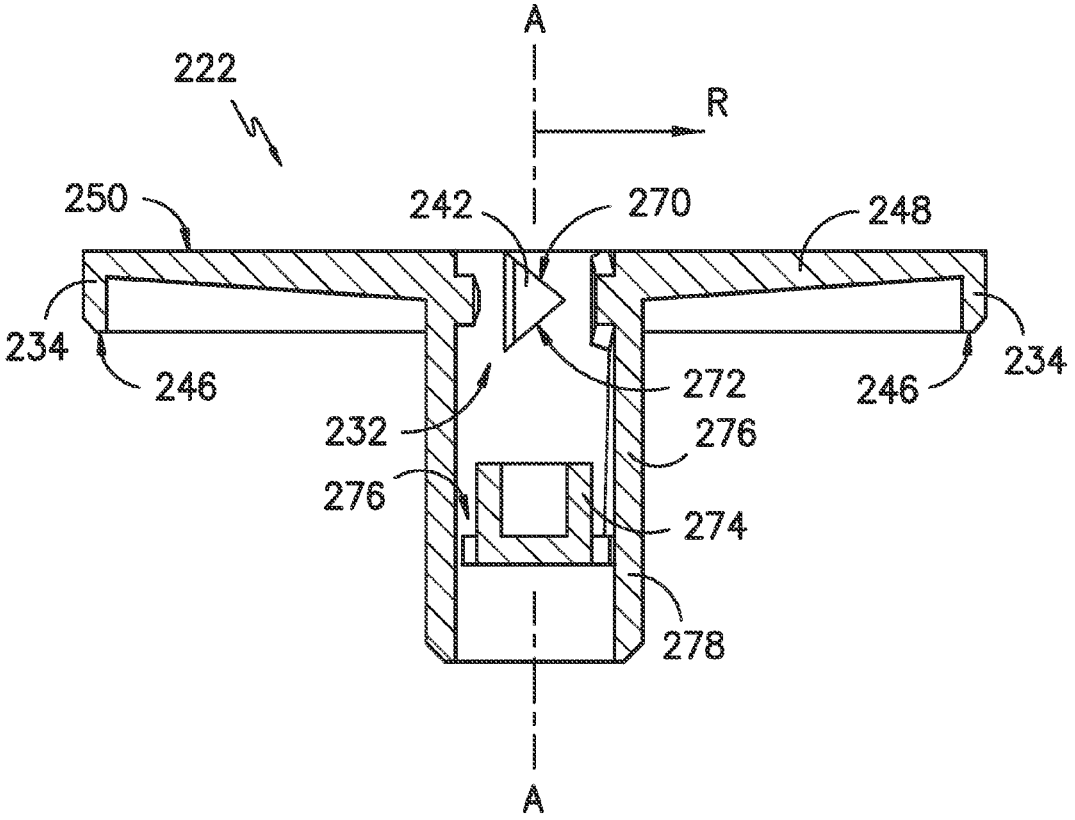
FIG. 10 is a cross-sectional, side view of the exemplary disk of FIG. 9.

As stated and shown, boss 240 is received into a channel 232 formed by disk 222. Referring to FIGS. 9 and 10, a plurality of cams 242 project along radial direction R into channel 232. Each cam 242 includes an upper contact face 270 and a lower contact face 272. A pin 274 forms a second recess or annulus 276 into which a second end of biasing element 228 is received.

Referring now to FIGS. 10 and 11, as a flow of fluid overcomes biasing element 228 and disk 222 moves from the first position (FIG. 4) towards the second position (FIG. 5), upper contact face 270 of each cam 242 contacts a guide element 258. Disk 222 is caused to rotate 45 degrees so that each cam 242 moves into a gap 262 between a pair of the second plurality of guide elements 258. This movement is guided by contact face 268. In this second position (FIG. 5), opening 230 is aligned with one of the outlet ports 202, 204, 206, or 208. As the flow of fluid is turned off, biasing element 228 causes disk 222 to move towards the first position (FIG. 4). During this movement, lower contact face 272 of each cam 242 contacts a guide element 256 and causes disk 222 to rotate another 45 degrees so that each cam 242 moves into a gap 264 between a pair of the first plurality of guide elements 256. This movement is guided by contact face 266. Upon returning to the second position, disk 222 is again caused to rotate by 45 degrees as previously described so that aperture 230 is now switched to the next outlet port. The process can be repeated to switch to still another outlet port.

Accordingly, during operation of appliance 100, controller 137 can be programmed to operate pump 154 and control the position of disk 222. For example, knowing the last outlet port through which fluid flow occurred, controller 137 can activate pump 154 to rotate disk 222 to the next outlet port in the direction of rotation of disk 222 so as to control the flow of fluid. Each time pump 154 is cycled off and back on to provide a flow of fluid through passive diverter 200 (e.g., during or between wash and rinse cycles), the controller 137 will "know" that disk 222 has been rotated to the next outlet port.

As stated, the passive diverter of the present invention may be used with more or less than four outlet ports. In such case, as will be understood by one of skill in the art using the teachings disclosed herein, the configuration of cams and guide elements described above can be modified to provide the desired amount of rotation between the selected number of outlet ports. Four cams along with four upper and four lower guide elements are used to provide 90 degrees of rotation between four outlet ports in the exemplary embodiment above described. By way of example, three cams along with three upper and three lower guide elements could be used to provide 120 degrees of rotation between three outlet ports and so forth.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A dishwasher appliance, comprising:

a tub that defines a wash chamber for receipt of articles for washing;

a pump for providing fluid flow for cleaning the articles;

a passive diverter that receives fluid flow from the pump, the passive diverter having an axial direction, the passive diverter having a plurality of outlet ports for providing fluid to the wash chamber, the passive diverter comprising a housing defining a chamber, the chamber having a fluid inlet and a fluid outlet to supply fluid to the outlet ports;

a disk positioned within the fluid outlet and rotatable about an axis, the disk defining an aperture for selectively controlling fluid flow from the chamber through one of the outlet ports, the disk movable along the axial direction between a first position and a second position, the disk defining a channel and a plurality of cams projecting into the channel, the disk further comprising a flange extending around the disk and projecting along the axial direction towards the fluid outlet, the flange configured to assist in capturing the momentum provided by fluid flow through the fluid outlet, wherein the flange rests on an interior surface of the housing when the disk is in the first position and is separated from the housing when in the second position;

a biasing element configured to urge the rotatable disk into the first position; and a boss extending from the housing into the channel of the disk, the boss defining a plurality of guide elements, wherein the guide elements and cams are configured to interact so that movement of the disk along the axial direction between the first position and the second position causes the disk to rotate about the axis.

2. The dishwasher appliance of claim 1, wherein the disk and biasing element are configured so that the rotatable disk is moved into the second position only by fluid flow through the fluid outlet of the chamber.

3. The dishwasher appliance of claim 1, wherein the interior surface of the housing is frustoconical in shape.

4. The dishwasher appliance of claim 1, wherein the boss defines a first recess into which a first end of the biasing element is received.

5. The dishwasher appliance of claim 1, wherein the disk defines a second recess within the channel, and wherein a second end of the biasing element is received into the second recess.

6. The dishwasher appliance of claim 1, wherein the boss is cylindrically-shaped and defines a circumferential direction and a radial direction, wherein the guide elements of the boss project along the radial direction and are spaced apart from each other along the circumferential direction, wherein the guide elements comprise a first plurality of guide elements and a second plurality of guide elements that are spaced apart from each other along the axial direction.

7. The dishwasher appliance of claim 6, wherein the guide elements each include at least one face positioned at a non-zero angle from the axial direction.

8. The dishwasher appliance of claim 7, wherein the guide elements each include at least one face positioned at an angle in the range of about 40 degrees to about 50 degrees from the axial direction.

9. The dishwasher appliance of claim 1, wherein the disk is rotatably received into a socket formed by the housing.

10. A passive diverter for selectively controlling fluid flow in an appliance, the passive diverter comprising:

a housing comprising a chamber and a plurality of fluid outlet ports for providing selective control of fluid flow for the appliance, the chamber having a fluid inlet and a fluid outlet to supply fluid to the outlet ports;

a disk positioned within the fluid outlet and rotatable about an axis, the disk defining an aperture for selectively controlling fluid flow from the chamber through one of the outlet ports, the disk movable along the axial direction between a first position and a second position, the disk defining a channel and a plurality of cams projecting into the channel, the disk further comprising a flange extending around the disk and projecting along the axial direction towards the fluid outlet, the flange configured to assist in capturing the momentum provided by fluid flow through the fluid outlet, wherein the flange rests on an interior surface of the housing when the disk is in the first position and is separated from the housing when in the second position;

a biasing element configured to urge the rotatable disk into the first position; and a boss extending from the housing into the channel of the disk, the boss defining a plurality of guide elements, wherein the guide elements and cams are configured to interact so that movement of the disk along the axial direction between the first position and the second position causes the disk to rotate about the axis.

11. The passive diverter of claim 10, wherein the disk and biasing element are configured so that the rotatable disk is moved into the second position only by fluid flow through the fluid outlet of the chamber.

12. The passive diverter of claim 10, wherein the interior surface of the housing is frustoconical in shape.

13. The passive diverter of claim 10, wherein the boss is cylindrically-shaped and defines a circumferential direction and a radial direction, wherein the guide elements of the boss project along the radial direction and are spaced apart from each other along the circumferential direction, wherein the guide elements comprise a first plurality of guide elements and a second plurality of guide elements that are spaced apart from each other along the axial direction.

14. The passive diverter of claim 13, wherein the guide elements each include at least one face positioned at a non-zero angle from the axial direction.

15. The passive diverter of claim 14, wherein the guide elements each include at least one face positioned at an angle in the range of about 40 degrees to about 50 degrees from the axial direction.

16. The passive diverter of claim 10, wherein the disk is rotatably received into a socket formed by the housing.

* * * * *